US010429761B2

(12) United States Patent
Takahashi

(10) Patent No.: US 10,429,761 B2
(45) Date of Patent: Oct. 1, 2019

(54) IMAGE FORMING APPARATUS USING ULTRAVIOLET AND INFRARED RADIATION

(71) Applicant: CANON KABUSHIKI KAISHA, Tokyo (JP)

(72) Inventor: Shuhei Takahashi, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/109,975

(22) Filed: Aug. 23, 2018

(65) Prior Publication Data

US 2019/0011850 A1 Jan. 10, 2019

Related U.S. Application Data

(63) Continuation of application No. PCT/JP2017/014431, filed on Mar. 31, 2017.

(30) Foreign Application Priority Data

Mar. 31, 2016 (JP) ..... 2016-072788
Jan. 19, 2017 (JP) ..... 2017-007790

(51) Int. Cl.
*G03G 15/20* (2006.01)
*G03G 15/043* (2006.01)
(Continued)

(52) U.S. Cl.
CPC ..... *G03G 15/043* (2013.01); *G03G 15/04036* (2013.01); *G03G 15/10* (2013.01); *G03G 15/2021* (2013.01); *G03G 15/2053* (2013.01)

(58) Field of Classification Search
CPC ..... G03G 15/043; G03G 15/04036; G03G 15/2007; G03G 2215/207; G03G 15/10; G03G 15/2021; G03G 15/2053
See application file for complete search history.

(56) References Cited

U.S. PATENT DOCUMENTS 6,608,987 B2 8/2003 Bartscher et al.
9,766,568 B2 9/2017 Ito et al.
(Continued)

FOREIGN PATENT DOCUMENTS

EP 3098664 A1 * 11/2016 ..... G03G 15/2007
JP 9-329986 A 12/1997
(Continued)

OTHER PUBLICATIONS

PCT International Search Report and the Written Opinion dated Jun. 27, 2017, in PCT/JP2017/014431.

*Primary Examiner* — Sophia S Chen
(74) *Attorney, Agent, or Firm* — Venable LLP

(57) ABSTRACT

An image forming apparatus includes an image forming portion for forming an image on a sheet by using a developer including toner, a feeding belt for feeding the sheet, an infrared irradiating portion for irradiating, with infrared radiation, the image on the sheet fed by the feeding belt, and an ultraviolet irradiating portion for irradiating, with ultraviolet radiation, the image on the sheet having been irradiated with the infrared radiation to fix the developer on the sheet by ultraviolet radiation. In addition, a controller controls operations of the feeding belt and the infrared irradiating portion, and causes the infrared irradiating portion to irradiate the feeding belt with the infrared radiation while causing the feeding belt to rotate in a stand-by state in which the controller waits for an execution instruction of an image forming operation in a state in which the image forming operation is capable of being started.

13 Claims, 8 Drawing Sheets

(51) Int. Cl.
*G03G 15/04* (2006.01)
*G03G 15/10* (2006.01)

(56) References Cited

U.S. PATENT DOCUMENTS

| | | | | |
|---|---|---|---|---|
| 2008/0176160 | A1* | 7/2008 | Deprez | G03G 9/0827 430/109.31 |
| 2008/0211895 | A1* | 9/2008 | Nishino | B41J 11/002 347/104 |
| 2015/0338816 | A1 | 11/2015 | Tadomi | |
| 2017/0185014 | A1* | 6/2017 | Komatsu | G03G 15/2007 |

FOREIGN PATENT DOCUMENTS

| | | | |
|---|---|---|---|
| JP | 11-202549 | A | 7/1999 |
| JP | 2002-207378 | A | 7/2002 |
| JP | 2004-151312 | A | 5/2004 |
| JP | 2004-184808 | A | 7/2004 |
| JP | 2009-175242 | A | 8/2009 |
| JP | 2015-127812 | A | 7/2015 |
| JP | 2015-219486 | A | 12/2015 |

* cited by examiner

| BOND | BOND ENERGY (kcal/mol) | DISSOCIATION ENERGY CORRESPONDING WAVELENGTH (nm) |
|---|---|---|
| C-C | 84.9 | 340 |
| C-C+F | 116.0 | 250 |
| C-H | 98.0 | 290 |
| C-O | 80.9 | 370 |

Fig. 12

IMAGE FORMING APPARATUS USING ULTRAVIOLET AND INFRARED RADIATION

TECHNICAL FIELD

The present invention relates to an image forming apparatus of an electrophotographic type.

BACKGROUND ART

Conventionally, in the image forming apparatus of the electrophotographic type, a constitution using a liquid developer has been known.

Japanese Laid-Open patent application (JP-A) 2015-127812 discloses a constitution of an image forming apparatus using a liquid developer of an ultraviolet curable type, in which the liquid developer transferred on a recording material (medium) is irradiated with ultraviolet radiation (rays), so that an image is fixed on the recording material.

SUMMARY OF THE INVENTION

Problem to be Solved by the Invention

In the image forming apparatus higher in productivity, it is required that the liquid developer is fixed on a sheet in a shorter time. However, as in JP-A 2015-127812, in a constitution in which after image formation, the liquid developer is fixed on the sheet only by irradiation with the ultraviolet radiation by an ultraviolet irradiating device, there was a liability that ultraviolet irradiation energy supplied to the liquid developer by the ultraviolet irradiating device is insufficient and a degree of curing of the liquid developer is insufficient.

Therefore, the present invention is aimed at providing an image forming apparatus capable of suppressing ultraviolet irradiation energy necessary to cure the developer.

Means for Solving the Problem

According to an aspect of the present invention, there is provided an image forming apparatus comprising: an image forming portion for forming an image on a sheet by using a developer including toner and a curable agent curable by ultraviolet radiation; a feeding belt for feeding the sheet on which the image is formed by the image forming portion; an infrared irradiating portion for irradiating, with infrared radiation, the image on the sheet fed by the feeding belt; an ultraviolet irradiating portion for irradiating, with the ultraviolet radiation, the image on the sheet having been irradiated with the infrared radiation by the infrared irradiating portion; and a controller for controlling operations of the feeding belt and the infrared irradiating portion, wherein the controller causes the infrared irradiating portion to irradiate the feeding belt with the infrared radiation while causing the feeding belt to rotate in a stand-by state in which the controller waits for an execution instruction of an image forming operation in a state in which the image forming operation is capable of being started.

BRIEF DESCRIPTION OF THE DRAWINGS

FIG. 12 is a table showing a dissociation energy corresponding wavelength of various bonds.

EMBODIMENTS FOR CARRYING OUT THE INVENTION

In the following, preferred embodiments of the present invention will be described specifically with reference to the attached drawings. Constituent elements described in the following embodiments are only examples, and are not intended to limit the present invention to those described in the embodiments.

[Embodiment 1]

(General Structure of Image Forming Apparatus)

Figure 1:
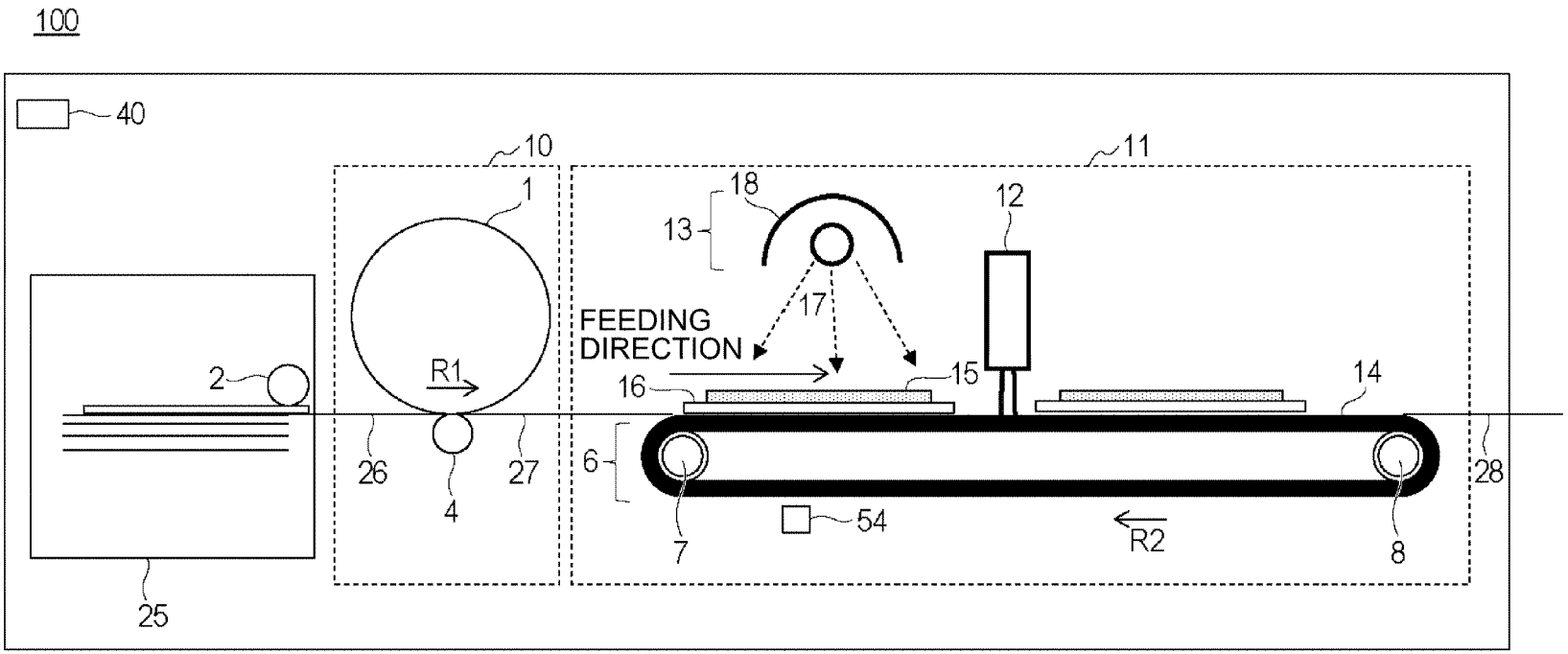
FIG. 1 is a schematic view showing an example of a structure of an image forming apparatus.
Figure 2:
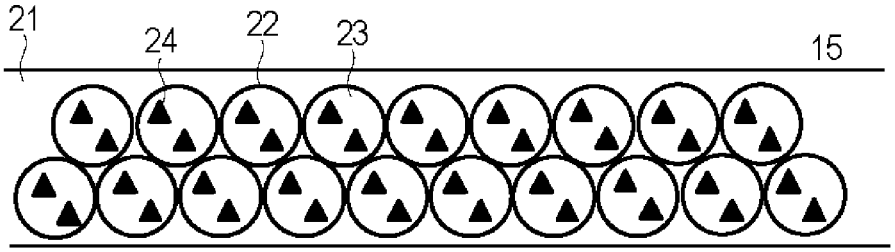
FIG. 2 is a sectional view of a liquid developer to be cured by ultraviolet radiation.

FIG. 1 is a schematic view showing an example of a structure of an image forming apparatus.

An image forming apparatus 100 includes an image forming portion 10 for forming an image on a recording material (sheet) 16 and a fixing portion 11 for fixing the image, formed on the recording material 16, on the recording material 16. A power (main) switch 40 is an actuation switch for actuating the image forming apparatus 100.

Here, the recording material 16 is a recording material on which a toner image is formed by the image forming apparatus 100 and, for example, includes sheets, such as plain paper, coated paper, postcard and an envelope. Further, for example, the recording material 16 may also be an OHP sheet or a film.

A cassette 25 is an accommodating portion for accommodating the recording material 16 used for image formation. The recording material 16 accommodated in the cassette 25 is fed to the image forming portion 10 by a feeding mechanism 2. The feeding mechanism 2 is, for example, a feeding roller and sends the recording material 16 in the cassette 25 toward a feeding path 26. The feeding mechanism 2 is driven by a driving means 52 (FIG. 10) for the feeding mechanism 2. Incidentally, the accommodating portion may also have a constitution including a plurality of cassettes and may also have a tray shape (e.g., a manual feeding tray).

The recording material 16 fed from the cassette 25 by the feeding mechanism 2 passes through the feeding path 26 and is supplied to a contact portion between an image holding member 1 and a transfer means 4. After the image on the image holding member 1 is transferred onto the recording material 16 by the transfer means 4 at the contact portion between the image holding member 1 and the transfer means 4, the recording material 16 passes through a feeding path 27 and is fed to a fixing portion 11.

The image forming portion 10 forms the image with a liquid developer (liquid) 15 on the recording material 16. The liquid developer 15 is a developer containing an ultraviolet curable agent curable by ultraviolet radiation (rays) and toner (a coloring material), and will be described specifically later. The image forming portion 10 includes a roller-shaped image holding member 1 and a roller-shaped transfer means 4. An image forming means (not shown) of an electrophotographic type includes a charging portion where the image holding member 1 is electrically charged to a uniform surface potential, an exposure portion where a latent image is formed by light exposure, and a developing portion where the latent image is developed using the liquid developer 15, and forms the image on the image holding member 1. The image formed on the image holding member 1 is transferred by a transfer roller as the transfer means 4 onto the recording material 16 supplied to the contact portion between the image holding member 1 and the transfer means 4. That is, by the image forming portion 10, on the recording material 16, an unfixed image is formed.

The image holding member 1 in this embodiment is an aluminum-made cylinder (photosensitive drum) which has an organic photosensitive layer of 3 mm in thickness and which has an outer diameter of 84 mm, and is 370 mm in long-side width (a length with respect to a direction substantially perpendicular to a recording material feeding direction). The image holding member 1 is rotationally driven about a center supporting shaft (axis) in an arrow R1 direction in FIG. 1 by a driving motor (DC brush-less motor) as a driving means (not shown) for the image holding member 1.

Incidentally, in this embodiment, the image holding member 1 had a constitution of a direct transfer type of the electrophotographic type, but an image forming method on the recording material 16 is not limited thereto. For example, a constitution using an intermediary transfer type in which the image holding member 1 is an intermediary transfer belt may also be employed. Specifically, the image formed on the photosensitive drum with the liquid developer 15 by the image forming means (not shown) is primary-transferred onto the intermediary transfer member by a primary transfer roller. The transfer means 4 is used as a secondary transfer roller and transfers the image from the intermediary transfer member onto the recording material 16.

The recording material 16 on which the image is formed at the image forming portion 10 passes through the feeding path 27 and is fed to the fixing portion 11.

The fixing portion 11 includes an infrared irradiating device (infrared irradiating portion) 13, an ultraviolet irradiating device (ultraviolet irradiating portion) 12 and a belt feeding portion 6.

The belt feeding portion 6 includes an endless feeding belt 14 provided with many holes and includes a driving roller 7 and a follower roller 8 which stretches the feeding belt 14. The belt feeding portion 6 includes a driving motor 53 (FIG. 10) for rotating the feeding belt 14 through the driving roller 7. The feeding belt 14 is rotated in an arrow R2 direction in the figure by drive of the driving motor 53. The belt feeding portion 6 carries, on the feeding belt 14, the recording material 16 on which the image is formed by the image forming portion 10 and feeds the recording material 16 so that the recording material 16 passes below the infrared irradiating device 13 and the ultraviolet irradiating device 12. In this embodiment, the feeding belt 14 is 350 mm in width and 600 mm in peripheral length.

Inside the feeding belt 14, a suction fan (not shown) as a suction device for attracting the sheet, fed by this feeding belt 14, to a peripheral surface of the feeding belt 14 through many holes formed in the feeding belt 14 is provided. That is, the suction fan sucks the air on an upper surface side of the feeding belt 14 and attracts the fed sheet onto an upper surface of the feeding belt 14.

A temperature sensor 54 as a detecting portion for measuring a temperature of the feeding belt 14 is a thermometer of a non-contact type. Incidentally, in this embodiment, a constitution in which the temperature sensor 54 directly detects the temperature of the feeding belt 14 is employed, but a measuring method of the temperature of the feeding belt 14 is not limited thereto. For example, a constitution in which a temperature sensor (for example, a thermistor) is provided on a member directly or indirectly contacting the feeding belt 14 of the belt feeding portion 6 and on the basis of an output of the temperature sensor, the temperature of the feeding belt 14 is indirectly measured may also be employed. In the case where the temperature of the feeding belt 14 is indirectly measured, for example, a CPU (control portion) 50 (FIG. 10) may also be constituted to control the temperature of the feeding belt 14 depending on the member directly or indirectly contacting the feeding belt 14. Further, for example, a storing means incorporated in the CPU 50 may also hold an output of the temperature sensor and temperature information of the feeding belt 14 corresponding thereto in advance. Further, as an example, in this embodiment, a single temperature sensor 54 is provided in a central portion of the feeding belt 14 with respect to a widthwise direction of the feeding belt 14. Incidentally, the widthwise direction of the feeding belt 14 refers to a direction perpendicular to a rotational direction of the feeding belt 14.

The infrared irradiating device 13 heats the liquid developer by irradiating an image with the liquid developer 15 on the recording material 16 (on the sheet) with irradiating radiation (rays). The ultraviolet irradiating device 12 fixes the image, on the recording material 16, of the image with the liquid developer 15 on the recording material 16 (on the sheet) by irradiating the recording material 16 with ultraviolet radiation (rays).

The recording material 16 subjected to a fixing process by the fixing portion 11 passes through a feeding path 28 and is discharged to an outside of the image forming apparatus.

(Liquid Developer)

Figure 3:
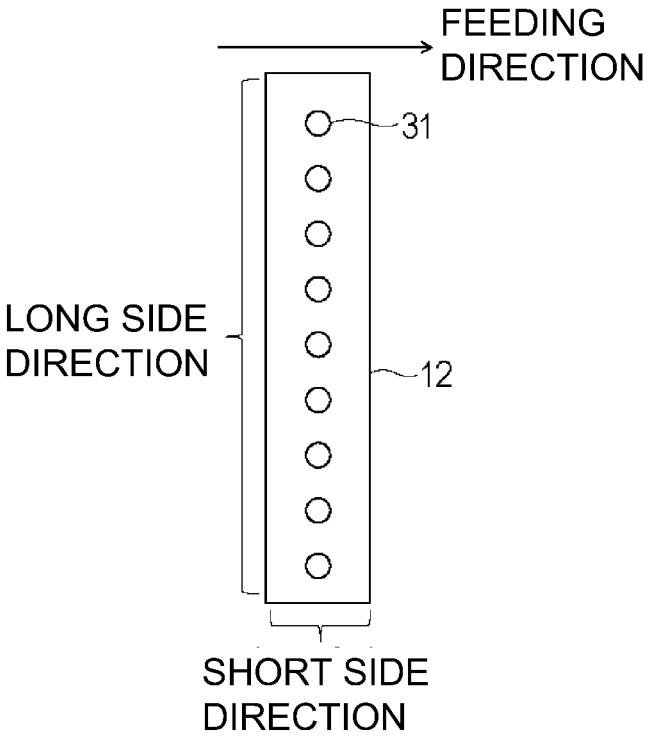
FIG. 3 is a schematic view showing an example of an arrangement of an LED of an ultraviolet irradiating device.

FIG. 3 is a sectional view of the liquid developer 15 to be cured by the ultraviolet radiation. The liquid developer 15 contains an ultraviolet curable agent 21 and toner 22. The ultraviolet curable agent 21 at least contains a photo-polymerization initiator and a monomer for the ultraviolet curable agent. The toner 22 contains a resin material 23 as a base material and a coloring material 24. For example, in the case of a cationic polymerization, when the ultraviolet curable agent is irradiated with the ultraviolet radiation, the photo-polymerization initiator excited by the ultraviolet radiation generates an acid, and the generated acid and the monomer start polymerization reaction, so that the ultraviolet curable agent 21 is cured.

Here, the ultraviolet curable agent 21 of the liquid developer 15 used in this embodiment is a cationic polymerizable monomer. The cationic polymerizable monomer is a vinyl ether compound, and it is possible to use dichloropendadiene vinyl ether, cyclohexanedimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentylglycol divinyl ether, pentaerythritol tetravinyl ether, and 1,2-decanediol divinyl ether.

The ultraviolet curable agent 21 (monomer) of the liquid developer 15 in this embodiment is a mixture of about 10% (wt. %) of a monofunctional monomer (formula 1) having one vinyl ether group and about 90% of a difunctional monomer (formula 2) having two vinyl ether groups.

(formula 1)

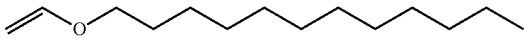

(formula 2)

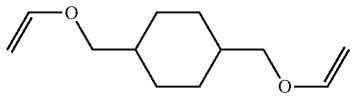

As the photo-polymerization initiator, a compound (formula 3) shown below is mixed in an amount of 0.1%. By using this photo-polymerization initiator, different from the case where an ionic photo-acid-generating agent is used, it is possible to obtain a high-resistance liquid developer 15 while achieving a good fixing property.

(formula 3)

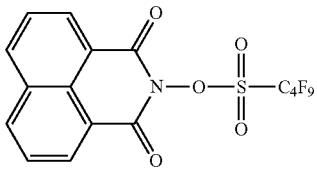

(Ultraviolet Irradiating Device)

The ultraviolet irradiating device 12 uses, as a light source, an LED (light emitting diode) for radiating the ultraviolet radiation. Here, the ultraviolet radiation refers to light with a wavelength of 200-400 nm. Of primary importance to ultraviolet curing reaction is the first law of photochemistry (Grotthuss-Drapper's law), i.e., that "a photochemical change is caused only by a fraction of incident light which is absorbed by a substance". That is, in the ultraviolet curing reaction, it is important that an absorption wavelength of a photo-polymerization initiator and an emission wavelength of the ultraviolet radiation coincide with each other. As regards the wavelength of the LED, there are LED light sources with peaks (spectral distribution peaks of radiant energy density) at 365±5 nm, 385±5 nm, and the like. Accordingly, the absorption wavelength of the photo-polymerization initiator or a sensitizer for inducing an excited state of the photo-polymerization initiator may preferably fall within these wavelength ranges (regions).

FIG. 3 is a schematic view showing an example of arrangement of the LED of the ultraviolet irradiating device. LEDs 31 radiating the ultraviolet radiation are disposed so as to oppose a region of the feeding belt 14 contacting the recording material 16 to be fed, and radiates the ultraviolet radiation to the recording material 16 on the feeding belt 14. Here, the ultraviolet irradiating device 12 includes the plurality of LEDs 31 so as to irradiate an entire region of the image with the ultraviolet radiation with respect to a widthwise direction (perpendicular to the feeding direction) of the recording material 16. The LEDs radiating the ultraviolet radiation may have a constitution in which the LEDs are arranged in a line along a long-side direction perpendicular to the feeding direction and may also have a constitution in which a plurality of arrays of the LEDs 31 as shown in FIG. 3 are arranged in a plurality of lines along the feeding direction.

Figure 4:
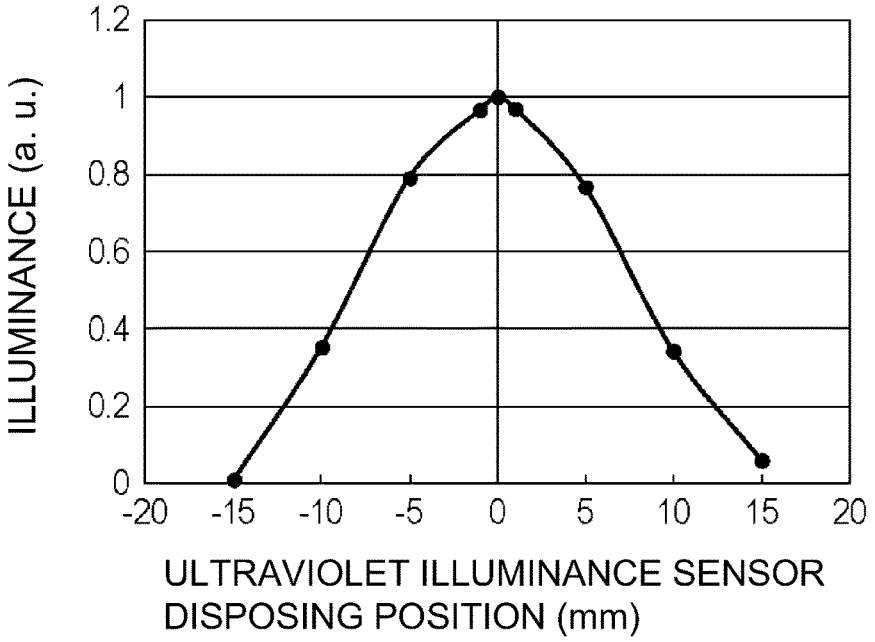
FIG. 4 is a graph showing an illuminance distribution of the ultraviolet irradiating device relative to a position of a member with respect to a feeding direction.

FIG. 4 is a graph showing an illuminance distribution of the ultraviolet irradiating device relative to a position of an illuminance sensor with respect to the recording material feeding direction. In this embodiment, as the ultraviolet irradiating device 12, an ultraviolet irradiating device in which the peak (spectral distribution peak of the radiant energy density) is in the wavelength range of 385±5 nm and a value thereof is 1.8 W/cm$^2$ will be described as an example. In FIG. 4, the position of the illuminance sensor immediately below the LEDs 31 is 0 (mm), and the illuminance sensors are provided at different positions with respect to the feeding direction of the recording material 16 and the illuminance by the ultraviolet irradiating device 12 is measured. That is, FIG. 4 shows the illuminance distribution of the ultraviolet irradiating device 12 relative to the position of the illuminance sensor with respect to the feeding direction of the recording material 16. In a positional distribution on a surface of an object to be irradiated with respect to the feeding direction, the illuminance which is a maximum illuminance is referred to as peak illuminance. In FIG. 4, the illuminance at the position (where the ultraviolet illuminance sensor position is 0 (mm)) immediately below the LEDs 31 is the peak illuminance.

Further, in this embodiment, a half peak width of the "illuminance (mW/cm$^2$) is about 20 mm. Incidentally, in FIG. 4, the unit "(a.u.)" represents an arbitrary unit.

Further, the irradiation energy (radiant energy) per unit area is a total amount ("integrated light quantity (mJ/cm$^2$)") of photons which reach the surface of the object to be irradiated. That is, the integrated light quantity is the product of integrated illuminance (mW/cm$^2$) and irradiation time (sec), i.e., ((mW×S)/cm$^2$), of the ultraviolet irradiating device 12 at each wavelength.

In the case where the image on the recording material 16 fed by the feeding belt 14 is irradiated with the ultraviolet radiation, an irradiation time of the ultraviolet radiation becomes shorter with a faster feeding speed. That is, when the feeding speed becomes fast and the irradiation time becomes short, the "integrated light quantity (mJ/cm$^2$)" of the ultraviolet radiation with which the liquid developer 15 on the recording material is irradiated by the ultraviolet irradiating device 12 becomes small.

In the case where the liquid developer 15 is not irradiated with the ultraviolet radiation necessary for curing thereof, curing reaction of the ultraviolet curing agent 21 does not progress sufficiently, so that there is a liability that improper fixing (fixing failure) onto the recording material 16 occurs.

Figure 5:
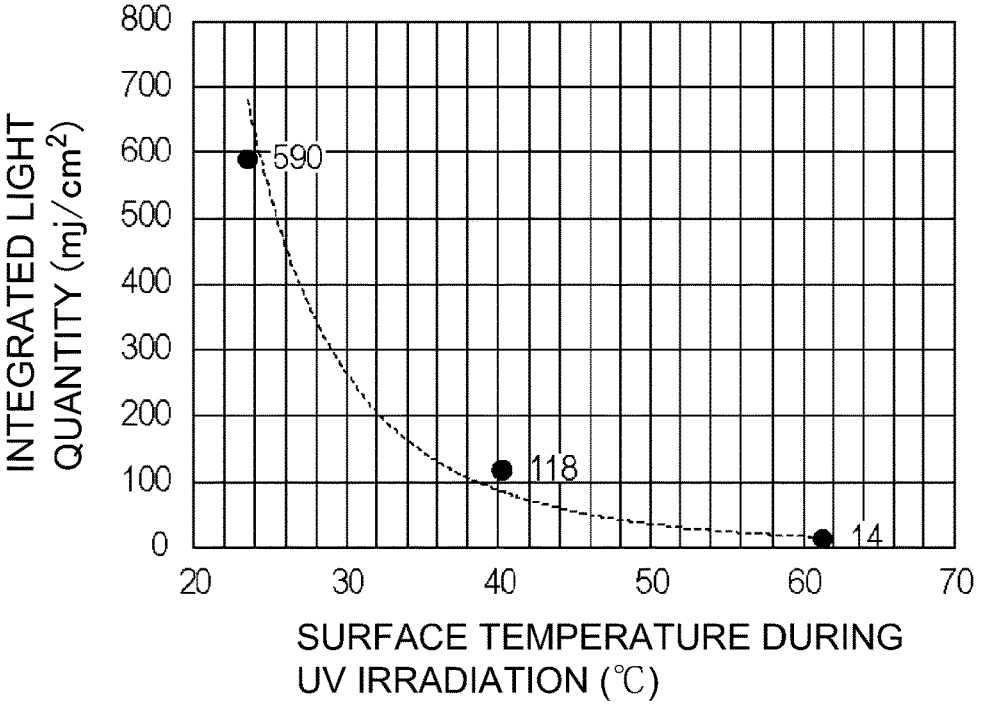
FIG. 5 is a graph showing an integrated light quantity of the ultraviolet radiation necessary for curing relative to a surface temperature of the liquid developer.

FIG. 5 is a graph showing an integrated light quantity (mJ/cm$^2$) of the ultraviolet radiation necessary to cure the liquid developer with respect to the surface temperature of the liquid developer. Thus, by increasing the surface temperature of the liquid developer 15 during the ultraviolet (UV) irradiation, the integrated light quantity (mJ/cm$^2$) of the ultraviolet radiation necessary to cure the liquid developer 15 can be made small.

(Infrared Irradiating Device)

The infrared irradiating device 13 irradiates the recording material 16 on the feeding belt 14 with the infrared radiation. An object of this infrared irradiating device 13 is to increase a temperature of the liquid developer 15 when the liquid developer on the recording material 16 is irradiated with the ultraviolet radiation. As described above, this is because by increasing the temperature of the liquid developer 15, the irradiation energy of the ultraviolet radiation necessary to cure the liquid developer 15 can be suppressed. In this embodiment, the infrared irradiating device 13 heats the liquid developer 15 so as not to cause the improper fixing even when the integrated light quantity of the ultraviolet radiation with which the liquid developer 15 is irradiated by the ultraviolet irradiating device 12 is 100 ($mJ/cm^2$). Specifically, the infrared irradiating device 13 heats the liquid developer 15 so that a surface temperature of the liquid developer 15 at an ultraviolet irradiation position is 40° C. or more. Incidentally, these values are an example, and are not limited thereto. By this, it is possible to provide the image forming apparatus capable of suppressing the illuminance of the ultraviolet radiation with which the developer should be irradiated.

The infrared irradiating device 13 is provided at a position, where the recording material 16 is heated, upstream of the ultraviolet irradiation position of the ultraviolet radiation irradiated by the ultraviolet irradiating device 12 with respect to the feeding direction of the recording material 16. Incidentally, the infrared irradiating device 13 may more preferably be provided at a position, where the recording material 16 is heated, immediately before the ultraviolet irradiation position.

Here, the ultraviolet irradiation position refers to a position where the illuminance by the ultraviolet irradiating device 12 is maximum (peak illuminance) as seen in a positional distribution with respect to the feeding direction of the recording material 16. Further, the infrared irradiation position refers to a position which is a center of a region in which the illuminance of the infrared irradiating device 13 is 90% or more of a peak illuminance of the infrared irradiating device 13 as seen in a positional distribution with respect to the feeding direction of the recording material 16.

The infrared irradiating device 13 includes an infrared heater 17 for radiating electromagnetic wave (infrared radiation) of a far infrared region wavelength (1000 nm-15000 nm) and a reflector 18 consisting of metal high in reflectance. The infrared heater 17 is a light source for irradiating the recording material 16 with the infrared radiation by the infrared irradiating device 13. The reflector 18 reflects the infrared radiation, toward the feeding belt 14, radiated by the infrared heater 17. By this, for infrared irradiating device 13 irradiates, with the infrared radiation, the recording material 16 fed by the feeding belt 14.

A vibration absorption wavelength of a chemical bond of an organic material is in a far infrared region, and therefore the liquid developer 15 can be efficiently heated by irradiation with the infrared radiation. For example, C—H bond absorbs infrared radiation of about 3.0 μm, and C═O bond absorbs infrared radiation of about 5.9 μm.

Incidentally, an infrared absorption wavelength of the ultraviolet curing agent 21 is distributed over a range of about 3 μm-12 μm. Accordingly, a wavelength of a principal infrared radiation with which the recording material 16 is irradiated by the infrared irradiating device 13 may more preferably be 3 μm-12 μm. As the infrared heater 17, for example, a silica tube heater or a ceramic heater can irradiate the recording material 16 with the infrared radiation of a wavelength falling in this region.

(Temperature of Feeding Belt)

The surface temperature of the liquid developer 15 at the ultraviolet irradiation position is also influenced by a temperature of the feeding belt 14. In the case where the temperature of the feeding belt 14 is low, even when the liquid developer 15 is heated by the infrared irradiating device 13, heat of the recording material 16 is taken by the feeding belt 14, with the result that the temperature of the liquid developer 15 at the ultraviolet irradiation position becomes insufficient and there is a liability that the temperature leads to a lowering in fixing property. Further, in the case where the temperature of the feeding belt 14 is high, in addition to the infrared radiation irradiation toward the liquid developer 15 by the infrared irradiating device 13, through the recording material 16, an effect of indirectly heating the liquid developer 15 can be expected.

For example, when the recording material 16 carrying the liquid developer 15 of 27° C. is fed by the feeding belt 14 of 30° C. so as to pass through the infrared irradiation position where the recording material 16 is irradiated with the infrared radiation with inputted electric power of 500 W, the liquid developer 15 at the ultraviolet irradiation position is 33° C. in temperature. On the other hand, when the recording material 16 carrying the liquid developer 15 of 27° C. is fed by the feeding belt 14 of 60° C. so as to pass through the infrared irradiation position where the recording material 16 is irradiated with the infrared radiation with the same inputted electric power of 500 W, the temperature of the liquid developer 15 at the ultraviolet irradiation position is 40° C. Incidentally, values of these temperatures and output are an example and are not limited to these values.

Therefore, before the fixing process is started, the temperature of the feeding belt 14 is controlled so that the temperature of the feeding belt 14 falls in a predetermined temperature range in advance. Here, a value of a target temperature range of the feeding belt 14 may only be required to be set appropriately depending on the constitution.

In this embodiment, before the fixing process is started, the feeding belt 14 is heated so that the temperature of the feeding belt 14 is in a predetermined temperature range (for example, about 60° C.) in advance by being irradiated with the infrared radiation by the infrared irradiating device 13. In addition to the irradiation of the liquid developer 15 with the infrared radiation at the infrared irradiation position during the image formation, by increasing the temperature of the feeding belt 14 in advance, an effect of more warming the liquid developer 15 can be obtained. In this case, a value of the target temperature range of the feeding belt 14 may only be required to be appropriately set in a temperature range in which an effect of enhancing the surface temperature of the liquid developer 15 at the ultraviolet irradiation position as much as possible is achieved compared with the case where if the feeding belt 14 is not heated before the fixing process is started.

Further, as described later, the image forming apparatus 100 of this embodiment maintains the temperature of the feeding belt 14 at a predetermined temperature range (for example, 35-45° C.) by irradiating the feeding belt 14 with the infrared radiation by the infrared irradiating device 13 in a stand-by state. By this, a time from input of a print execution instruction signal to the CPU 50 until print starts. Incidentally, the value of the target temperature range of the feeding belt 14 in the stand-by state is an example and is not limited thereto. For example, the value of the target temperature range may also be 45-55° C.

Further, the temperature of the feeding belt 14 may desirably be maintained in the predetermined temperature range (for example, about 60° C.) even during continuous image formation.

(Feeding Belt)

Figure 6:
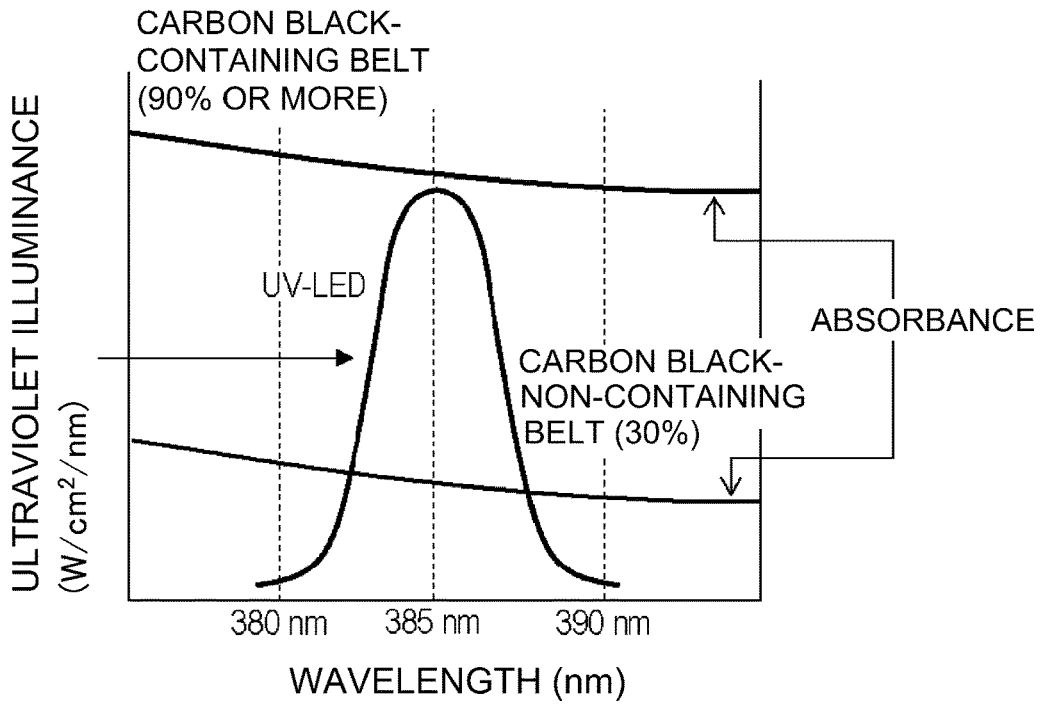
FIG. 6 is a graph illuminance of a UV-LED and a wavelength distribution of absorbance of a feeding belt.

The feeding belt 14 contains carbon black. FIG. 6 is a graph showing an illuminance of a UV-LED and a wavelength distribution of absorbance of the feeding belt. A center wavelength of the UV-LED is 385 nm and is the same as a center wavelength of the light source of the ultraviolet irradiating device 12 in this embodiment. The feeding belt 14 in this embodiment is a belt containing EPDM (ethylene-propylene-diene rubber) as a main component and containing carbon black, a cross-linking agent, an antidegradant and the like as sub-components. For example, the feeding belt 14 is a belt in which 38 weight parts of carbon black is added to 100 weight parts of EPDM. Further, for example, a volume resistivity of the feeding belt 14 is 1E+7 (Ω.cm). Incidentally, EPDM as the main component may also be nitrile rubber (NBR), chloroprene rubber (CR), urethane rubber, fluorine-containing rubber.

The feeding belt of 0% in carbon black content is about 30% in absorbance at the ultraviolet radiation region wavelength as shown in FIG. 6 although it varies depending on a surface shape. When the carbon black content increases, the absorbance of the feeding belt increases. The absorbance of the feeding belt 14 in this embodiment is 90% or more as shown in FIG. 6. Thus, the feeding belt 14 of this embodiment in which the carbon black is contained more absorbs the ultraviolet radiation, and therefore, the feeding belt 14 is efficiently heated by the ultraviolet radiation irradiation more than the feeding belt containing no carbon black.

Incidentally, as the constitution of the feeding belt 14, a constitution in which in place of or in addition to the carbon black, a solid material (carbon material) constituted by a carbon atom such as activated carbon, nanocarbon or graphite may also be employed. That is, the feeding belt 14 contains a carbon material selected from the group consisting of the carbon black, the activated carbon, the nanocarbon, and the graphite.

Figure 7:
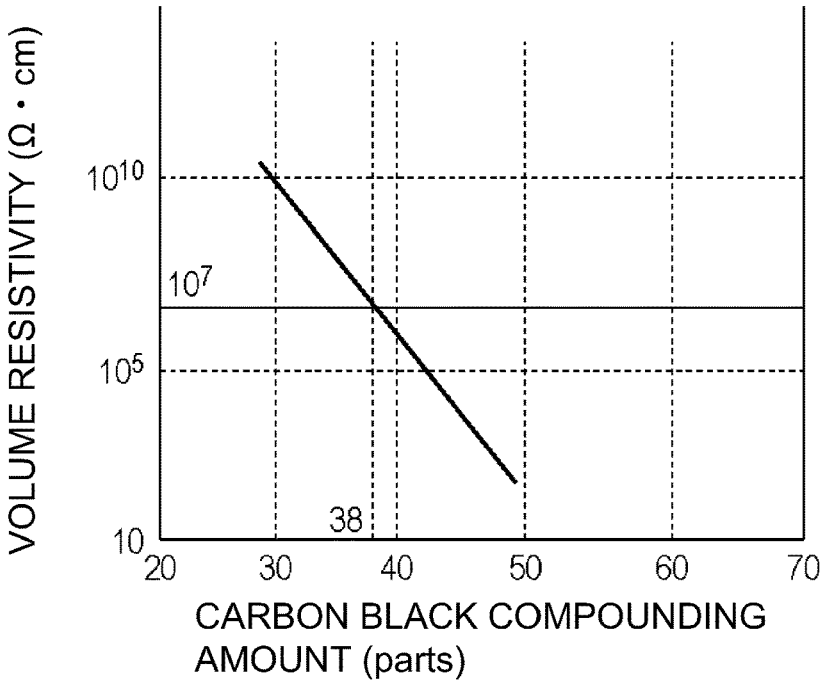
FIG. 7 is a graph showing a relationship between containing parts of carbon black and volume resistivity.

Incidentally, the volume resistivity of the feeding belt may desirably be less than $10^{10}$ (ohm.cm). This is because when the volume resistivity is $10^{10}$ (ohm.cm) or more, the feeding belt 14 is liable to be electrically charged and there is a liability that such a volume resistivity leads to improper separation of the recording material 16. FIG. 7 is a graph showing a relationship between content parts and a volume resistivity of the carbon black. When the carbon black is contained in the EPDM, the volume resistance lowers. Here, an amount of the carbon black contained in 100 weight parts of the EPDM as the feeding belt 14 may preferably be more than 30 weight parts. Further, as regards a dispersion state of the carbon black, there is a liability that belt strength lowers when the carbon black is localized, and therefore, the carbon black may preferably be uniformly dispersed.

Figure 8:
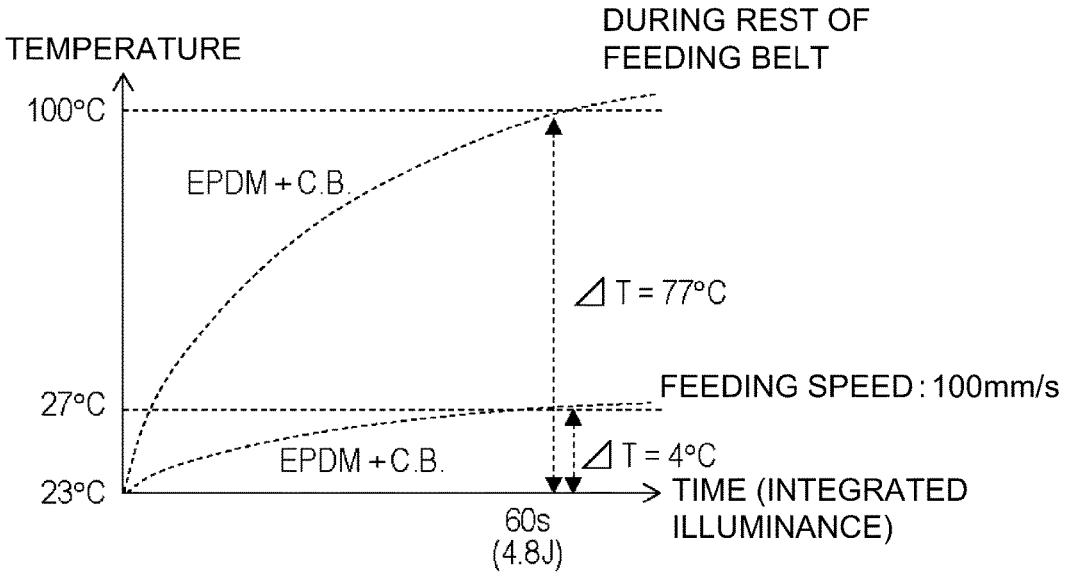
FIG. 8 is a graph showing a relationship between an irradiation time of the ultraviolet radiation and a temperature of the feeding belt.

FIG. 8 is a graph showing a relationship between an irradiation time of the ultraviolet radiation and the temperature of the feeding belt. For example, in the case where the feeding belt 14 rotating at a speed of 100 (mm/s) is not irradiated with the infrared radiation by the infrared irradiating device 13 but is irradiated with the ultraviolet radiation of 1.0 W/cm$^2$ for 60 seconds by the ultraviolet irradiating device 12, the temperature of the feeding belt 14 at the ultraviolet irradiation position increases from 23° C. to 27° C.

Figure 9:
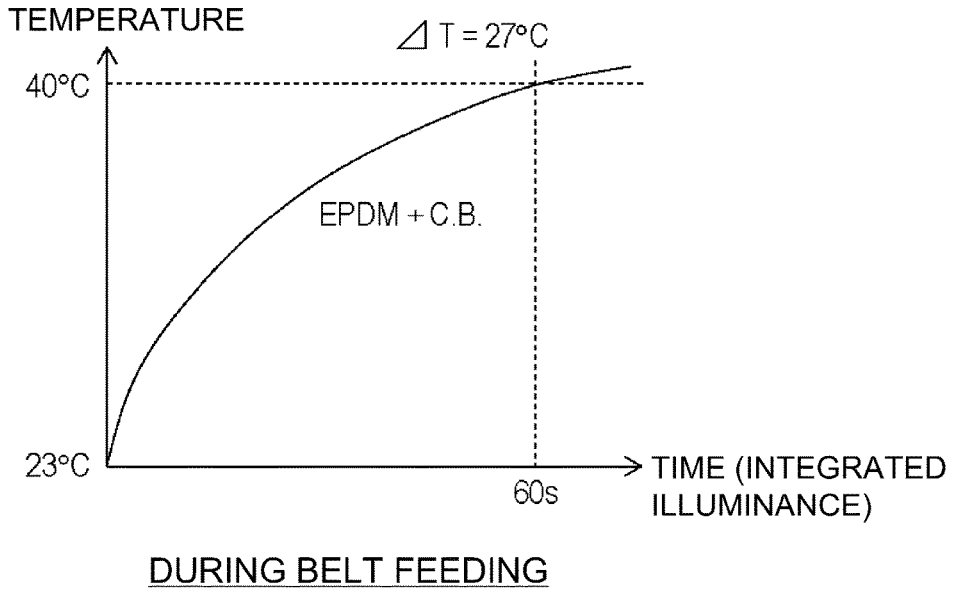
FIG. 9 is a graph showing a relationship between an irradiation time of the ultraviolet radiation and a temperature of the feeding belt.

FIG. 9 is a graph showing a relationship between an irradiation time of the infrared radiation and the temperature of the feeding belt. For example, in the case where the feeding belt 14 rotating at a speed of 100 (mm/s) is not irradiated with the ultraviolet radiation by the ultraviolet irradiating device 12 but is irradiated with the infrared radiation with the input electric power of 500 W for 60 seconds similarly as in FIG. 8 by the infrared irradiating device 13, the temperature of the feeding belt 14 at the ultraviolet irradiation position increases from 23° C. to 40° C.

As an effect of increasing the temperature of the feeding belt 14, the effect is larger by the irradiation with the infrared radiation than by the irradiation with the ultraviolet radiation, but the temperature increasing effect is also achieved even by the irradiation with the ultraviolet radiation by the ultraviolet irradiating device 12.

(Operation Sequence)

Figure 10:
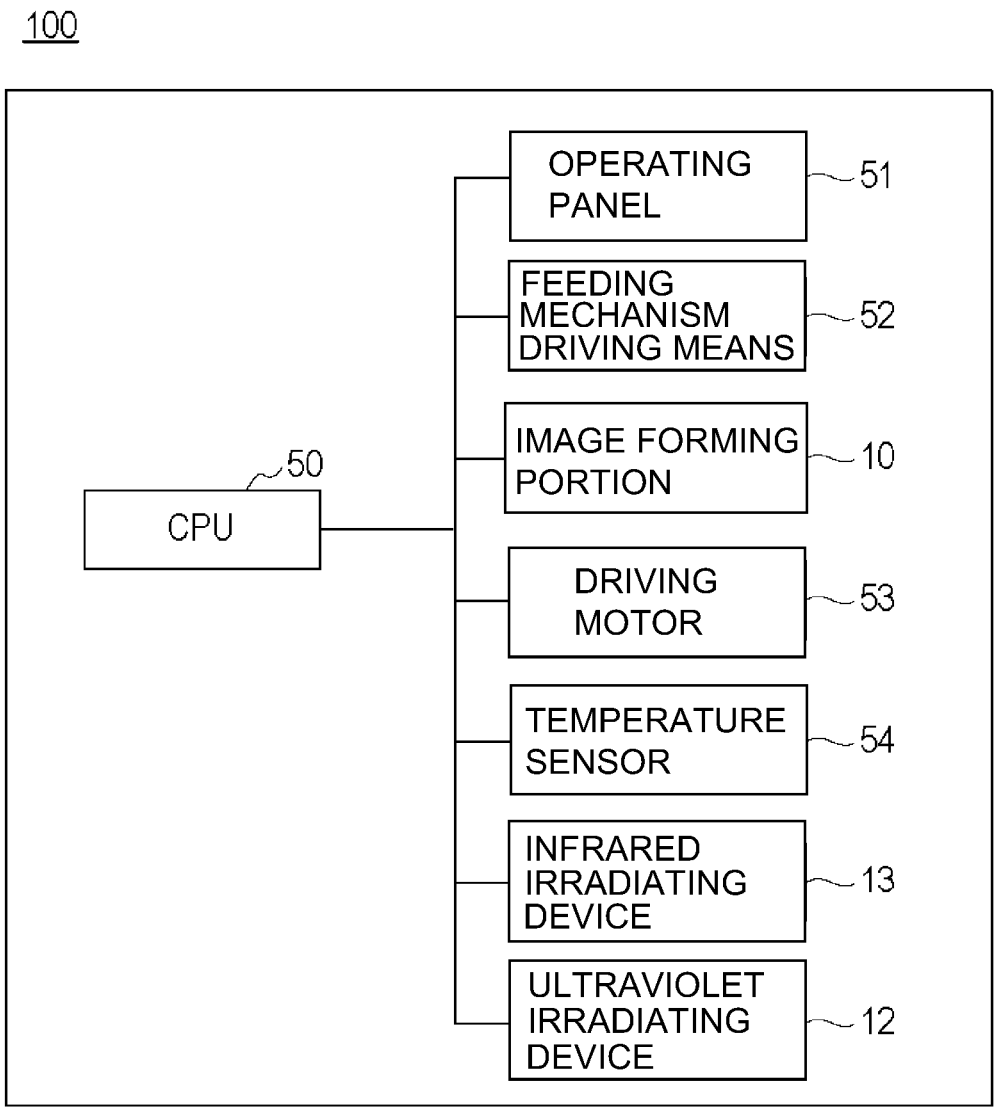
FIG. 10 is a block diagram showing an example of a structure relating to control.

FIG. 10 is a block diagram showing an example of a constitution relating to control.

The image forming apparatus 100 includes an operation panel 51. The operation panel 51 includes a display panel as a display means (display portion) for displaying information by an instruction of the CPU (central processing unit) 50 as a control portion (controller) and includes operation buttons as input means (input portion) to which an operator inputs an instruction. The operation panel 51 displays a state of an apparatus main assembly and menus when various adjustments are carried out.

The CPU 50 functions as the control portion (controller) for effecting centralized control of the operation of the image forming apparatus 100. The CPU 50 executes control of various devices electrically connected with the CPU 50 in accordance with programs and data stored in storing means (electronic memories or the like) incorporated therein. For example, the CPU 50 is connected with the driving means 52 for the feeding means and the driving motor 53 for the feeding belt 14 and controls drive and stop (of the drive) of the respective driving means. The CPU 50 is connected with the image forming portion 10 and controls the image forming operation by the image forming portion 10. Further, the CPU 50 is connected with the temperature sensor 54 and acquires a measured value. Further, the CPU (control portion) 50 is electrically connected with the ultraviolet irradiating device 12 and the infrared irradiating device 13 and controls ON, OFF and output of these devices. As described later, in this embodiment, the CPU 50 controls an operation of the infrared irradiating device 13 depending on an output of the temperature sensor 54.

Incidentally, in this embodiment, as regards a constitution relating to the control, a constitution in which a single CPU realizes a plurality of functions (for example, the control of the driving motor 53, the control of the infrared irradiating device 13 and the like) is an example, but a constitution in which a plurality of CPUs or control circuits are provided may also be employed. For example, a constitution in which a control circuit for controlling the driving motor 53 and a control circuit for controlling the infrared irradiating device 13 on the basis of the output of the temperature sensor 54 are provided and in which these control circuits are operated by the CPU 50 in accordance with programs may also be employed.

Incidentally, the constitution of the storing means is not limited to the constitution in which the storing means is incorporated in the CPU 50 but a constitution in which a memory electrically connected with the CPU 50 in the form of a separate member from the CPU 50 is provided in the image forming apparatus 100 and functions as a storing means for storing the programs and data may also be employed.

Figure 11:
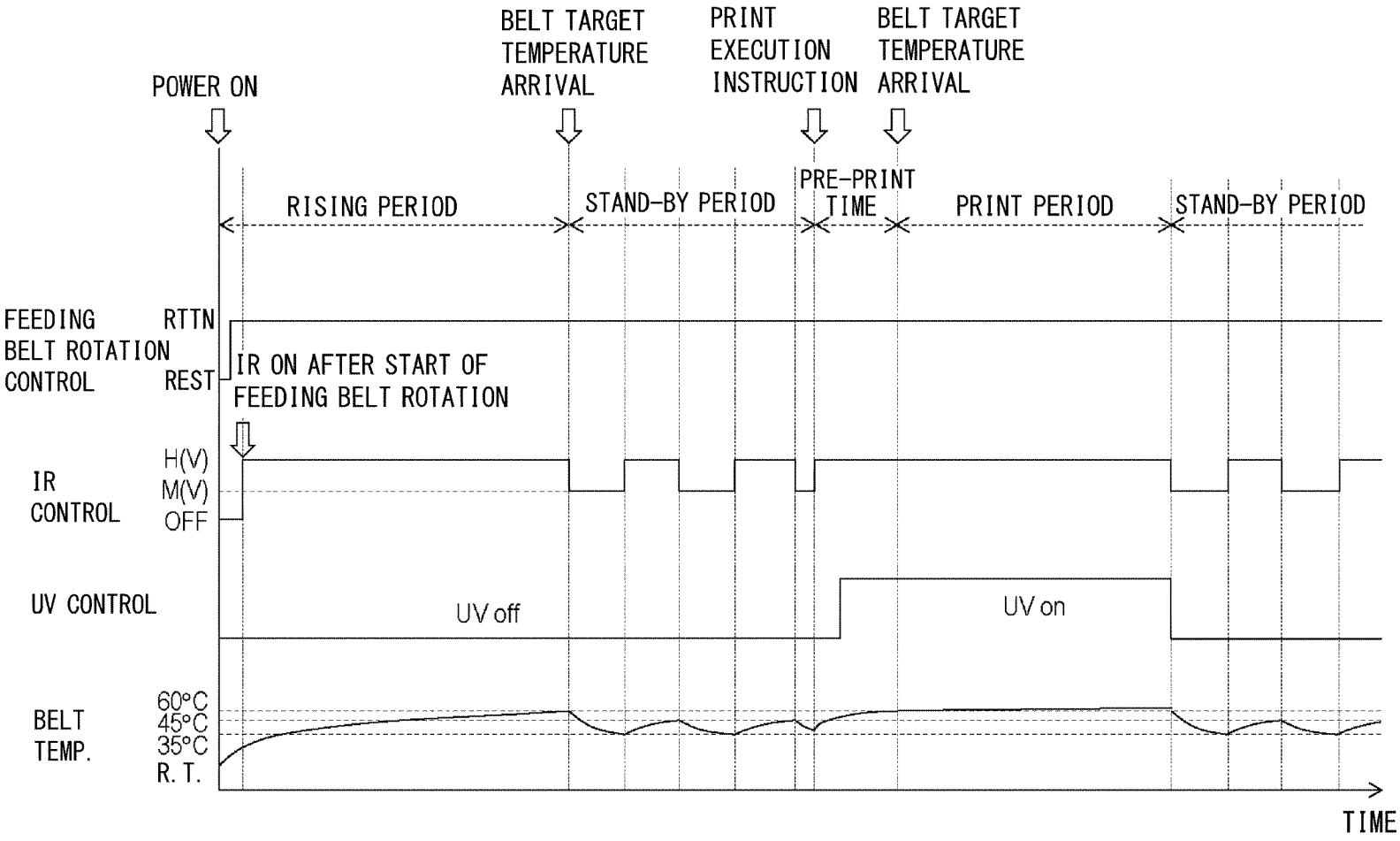
FIG. 11 is a timing chart relating to control.

FIG. 11 is a timing chart relating to the control. While making reference to FIG. 11, an example of an operation of the fixing portion 11 and an example of the image forming apparatus will be shown. Incidentally, IR in FIG. 11 refers to the infrared radiation with which the feeding belt 14 is irradiated by the infrared irradiating device 13, and UV refers to the ultraviolet radiation with which the feeding belt 14 is irradiated by the ultraviolet irradiating device 12. Incidentally, in this embodiment and in other embodiments, control of the operations of the fixing portion 11 and the image forming apparatus 100 shown in the timing chart is carried out by execution of control programs, stored in the storing means incorporated in the CPU 50, by the CPU 50 functioning as an executing portion (control portion).

A rising period refers to a period from turning-on of the power switch 40 until the image forming apparatus 100 is in a state in which the image forming apparatus 100 can start the image forming operation. In the rising period, the image forming apparatus 100 executes a preparatory operation (rising operation) for placing the image forming apparatus 100 in a state in which an image forming process can be started. Incidentally, as the rising operation, in parallel to heating of the feeding belt 14 described later, an operation (for example, a preparatory operation or the like of the image forming portion 10) other than the heating of the feeding belt 14 may also be executed.

When the power switch 40 is turned on, the CPU 50 is actuated, so that the image forming apparatus 100 is caused to start the rising operation. First, the CPU 50 sends a drive start signal to the driving motor 53 for the feeding belt 14, so that the driving motor 53 is rotated. By this, the feeding belt 14 is rotated.

Then, the CPU 50 causes a voltage source of the infrared irradiating device 13 to be turned on (turning-on voltage source potential V=H(V)), so that the infrared heater 17. Incidentally, a constitution in which the infrared heater 17 is turned on after the feeding belt 14 starts rotation may more preferably be employed. This is because when the feeding belt 14 in a rest state of the infrared irradiating device 13 is continuously irradiated with the infrared radiation, the feeding belt 14 is heated and there is a liability that temperature non-uniformity generates at an entirety of the feeding belt 14.

The CPU 50 maintains the turning-on voltage source potential of the infrared irradiating device 13 at V=H(V) until the temperature of the feeding belt 14 becomes a target temperature (in this embodiment, 60° C.), hereinafter, referred to as a rising temperature, so that the feeding belt 14 is heated. Here, the feeding belt 14 continuously rotates for irradiating an entirety thereof with the infrared radiation.

In the rising period, the infrared irradiating device 13 heats the feeding belt 14. In a period from the turning-on of the infrared heater 17 until the temperature of the feeding belt 14 reaches the rising temperature, the CPU 50 does not cause the ultraviolet irradiating device 12 to irradiate the feeding belt 14 with the ultraviolet radiation (UV off). This is because as described above, the effect of warming the feeding belt 14 is larger by the infrared radiation irradiation than by the ultraviolet radiation irradiation. Incidentally, as an exception, for example, a constitution in which in order to perform a checking operation for checking whether or not the ultraviolet irradiating device 12 is properly turned on, the feeding belt 14 is irradiated with the ultraviolet radiation instantaneously (about 3 seconds at longest) during the rising period by the ultraviolet irradiating device 12 may also be employed.

On the basis of an output of the temperature sensor 54, the CPU 50 detects that the temperature of the feeding belt 14 reached the target temperature. When the temperature of the feeding belt 14 reaches the target temperature, the rising operation of the fixing portion 11 is completed.

In the case where the image forming apparatus 100 receives an execution instruction (for example, print reservation) before the rising operation is completed, the image forming apparatus 100 starts an image forming operation corresponding to the execution instruction with completion of the rising operation without going to a stand-by state described later. On the other hand, in the case where the image forming apparatus 100 does not receive the execution instruction before the completion of the rising operation, the image forming apparatus 100 goes to the stand-by state with the completion of the rising operation. The stand-by state refers to a state which is a state in which the image forming apparatus 100 is capable of starting the image forming operation and in which the image forming apparatus 100 waits for the execution instruction. A period in which the image forming apparatus 100 is in the stand-by state is referred to as a stand-by period. In the stand-by state, the CPU 50 displays, on the operation panel 51, information showing that the image forming apparatus 100 is in the stand-by state (for example, "COPYABLE", "PRINTABLE", "RISING COMPLETED", and the like), and notifies an operator that the image forming apparatus 100 is in the stand-by state.

In this embodiment, in the case where the image forming apparatus 100 does not receive the execution instruction, when the rising operation of the fixing portion 11 is completed, the image forming apparatus 100 goes to the stand-by state. In this embodiment, a time from the turning-on of the infrared heater 17 until the temperature of the feeding belt 14 reaches the target temperature is about 10 minutes. Incidentally, even when the temperature of the feeding belt 14 reaches the target temperature, in the case where the rising operation (for example, the preparatory operation of the image forming portion 10, or the like) other than the rising operation of the fixing portion 11, the CPU 50 causes the image forming apparatus 100 to go to the stand-by state after waiting for completion of the rising operation other than the rising operation of the fixing portion 11.

The execution instruction from the operator is inputted from the operator through the operation panel 51. Incidentally, the image forming apparatus 100 may be constituted so as to be connectable with an external computer through a network, and the CPU 50 may also be constituted so as to receive the execution instruction through the network.

The CPU controls the output of the infrared heater 17 so that the temperature of the feeding belt 14 is maintained in a predetermined temperature range (in this embodiment, between 35° C. and 45° C., in the following this temperature is referred to as a stand-by temperature) in the stand-by period. In this embodiment, an upper-limit target temperature is 45° C., and a lower-limit target temperature is 35° C. That is, the CPU 50 causes the feeding belt 14 to accumulate the heat.

As described above, the time of about 10 minutes is required from the turning-on of the infrared heater 17 until the temperature of the feeding belt 14 reaches the rising temperature. In order to shorten a time from the input of the execution instruction signal of the print to the CPU 50 to a start of the print, in the image forming apparatus 100, in the stand-by period, the temperature of the feeding belt 14 is maintained in a predetermined temperature range by the infrared irradiating device 13.

Specifically, the CPU 50 aims at maintaining the temperature of the feeding belt 14 which is the rising temperature (in this embodiment, 60° C.) at an upper-limit target temperature (in this embodiment, 45° C.) or less. The CPU 50 changes the voltage source potential to an intermediary voltage source potential (V=M(V)) so that the output of the infrared irradiating device 13 is weakened. When a state of the intermediary voltage source potential is continued, the temperature of the feeding belt 14 lowers. When the temperature of the feeding belt 14 lowers to the lower-limit target temperature (in this embodiment, 35° C.), the CPU 50 switches the voltage source potential to a voltage source potential V=H(V), so that the output of the infrared radiation is strengthened. Further, when the temperature of the feeding belt 14 increases up to the upper-limit target temperature (in this embodiment, 45° C.), the CPU 50 switches the voltage source potential to the intermediary voltage source potential (V=M(V)), so that the output of the infrared radiation is weakened. By maintaining the temperature of the feeding belt 14 at the stand-by temperature in the stand-by period, the time of the input of the print execution instruction signal to the CPU 50 to the print start can be shortened. On the basis of the output of the temperature sensor 54, the CPU 50 detects that the temperature of the feeding belt 14 reached the target temperature.

In this embodiment, while rotating the feeding belt 14, an entirety of a region through which the recording material 16 is capable of passing with respect to the widthwise direction of the feeding belt 14 is irradiated with the infrared radiation by the infrared irradiating device 13, so that an entirety of the feeding belt 14 is heated. In response to that the temperature sensor 54 provided at a central portion with respect to the widthwise direction of the feeding belt 14 detects that the temperature of the feeding belt 14 reached the target temperature, the CPU 50 discriminates that the entirety of the feeding belt 14 reached the target temperature. Incidentally, this is ditto for the rising temperature and the print temperature.

Incidentally, the target temperature may also be set at a value determined in consideration of temperature non-uniformity with respect to the widthwise direction and a circumferential direction of the feeding belt 14. For example, the temperature of the entirety of the feeding belt 14 is intended to be changed to 35° C. or more, in response to that the detected temperature by the temperature sensor 54 reached 37° C., the CPU 50 discriminates that the temperature of the entirety of the feeding belt 14 reached the target temperature (35° C.).

Incidentally, in this embodiment, a constitution in which the CPU 50 discriminates that the temperature of the feeding belt 14 reached the target temperature through the detection of the target temperature by a single temperature sensor 54 was employed, but the following constitution may also be employed. For example, a constitution in which temperature sensors 54 are provided at a plurality of positions with respect to the widthwise direction of the feeding belt 14 and in which the CPU 50 discriminates that the temperature of the entirety of the feeding belt 14 is the target temperature through detection of the target temperature by all the temperature sensors 54 may also be employed. Further, for example, a constitution in which the CPU 50 discriminates that the temperature of the entirety of the feeding belt 14 is the target temperature through detection of the target temperature over one-full-turn period of the feeding belt 14 by the temperature sensor 54 may also be employed. Incidentally, these are ditto for the rising temperature and the print temperature.

Further, in the stand-by period, the temperature sensor 54 detects the temperature of the feeding belt 14 at a sufficiently short interval and outputs the temperature of the feeding belt 14 to the CPU 50.

Incidentally, in this embodiment, a constitution in which the infrared irradiating device 13 is continuously turned on over the stand-by period while continuously rotating the feeding belt 14 was employed, but a constitution in which during the stand-by period, a rest (stop) period is provided when the rest period is a temporary period. The rest period is a period in which the rotation of the feeding belt 14 stops and the infrared irradiating device 13 is turned off. "when the rest period is a temporary period" means within a range such that an effect of shortening the time from the input of the print execution instruction signal to the CPU 50 to the print start is obtained. That is, in the constitution in which the temporary rest period is provided, the image forming apparatus 100 includes during the stand-by period, the temperature rest period in addition to a period in which the infrared irradiating device 13 is continuously turned on while continuously rotating the feeding belt 14.

Incidentally, in this embodiment, a constitution in which in the stand-by period, the CPU 50 controls the temperature of the feeding belt 14 without turning off (the infrared radiation output of 0) of the infrared irradiating device 13 was employed, but a control method is not limited thereto. For example, the CPU 50 may also control the temperature of the feeding belt 14 by repeating ON (turning-on state)/OFF (turning-off state) of the infrared irradiating device 13. Also in this case, the CPU 50 controls the output of the infrared irradiating device 13.

Incidentally, in this embodiment, the stand-by temperature is a temperature lower than the rising temperature, but the stand-by temperature may also be the same temperature as the rising temperature. However, as in this embodiment, by making the stand-by temperature the temperature lower than the rising temperature, electric power consumption in the stand-by state can be suppressed.

In the stand-by period, the feeding belt 14 continuously rotates in order to maintain the temperature of the entirety of the feeding belt 14 at the stand-by temperature. When the infrared irradiating device 13 continuously irradiates the feeding belt 14 in the rest state with the infrared radiation, there is a liability that the feeding belt 14 is locally heated. Thus, the feeding belt 14 continuously rotates in the stand-by state, whereby a liability that the temperature non-uniformity generates at the entirety of the feeding belt 14 can be suppressed. Incidentally, a constitution in which a rotational speed of the feeding belt 14 in the stand-by state is slower than a rotational speed of the feeding belt 14 during the print may also be employed. A liability that a lifetime of the feeding belt 14 is lowered by sliding of the feeding belt 14 with a member contacting the feeding belt 14 can be suppressed. Further, incidentally, the rotation of the feeding belt 14 may also be intermittent rotation. For example, the feeding belt 14 may stop for 2-3 seconds of one minute.

In the stand-by period, the infrared irradiating device 13 heats the feeding belt 14. Further, in the stand-by period, the CPU 50 does not cause the ultraviolet irradiating device 12 to irradiate the feeding belt 14 with the ultraviolet radiation (UV off). This is because as described above, the effect of warming the feeding belt 14 is larger by the infrared radiation irradiation than by the ultraviolet radiation irradiation. In the stand-by period, the ultraviolet irradiating device 12 is prevented from irradiating the feeding belt 14 with the ultraviolet radiation, whereby the electric power consumption in the stand-by period can be suppressed.

Incidentally, in the case where the rising operation other than the rising operation of the fixing device 11 is not completed even when the temperature of the feeding belt 14 reaches the rising temperature, the CPU 50 may also have a constitution in which the CPU 50 switches the target temperature of the feeding belt 14 to the stand-by temperature before the CPU 50 notifies an operator that the image forming apparatus is in the stand-by state. Also in this case, in the stand-by state, the CPU 50 controls the output of the infrared heater 17 so that the temperature of the feeding belt 14 is maintained at the stand-by temperature.

In the stand-by state, when the print execution instruction is inputted to the CPU 50, the image forming apparatus 100 executes the image forming operation corresponding to the execution instruction. When the print corresponding to the execution instruction ends without inputting a new execution instruction to the CPU 50 during the print, the image forming apparatus 100 goes to the stand-by state again and waits for a subsequent execution instruction in a state in which the image forming operation can be started.

Here, a period from the input of the print execution instruction to the CPU 50 until the image forming portion 10 starts to form the image on the photosensitive drum is referred to as a pre-print period. Further, a period from the start of formation of the image on the photosensitive drum by the image forming portion 10 to the time when a final recording material 16 corresponding to the execution instruction is discharged to the outside of the image forming apparatus (i.e., the time when the print corresponding to the execution instruction ends) is referred to as a print period. Specifically, the feeding path 28 includes a passage sensor (not shown) for detecting passage of the recording material 16 immediately behind a discharging roller pair (not shown) for discharging the recording material 16 to the outside of the image forming apparatus. The CPU 50 detects the discharge of the final recording material 16 on the basis of the output of this sensor. Incidentally, a detecting method of timing when the recording material 16 is discharged is not limited thereto, but a constitution in which from an output of a passage sensor provided on a further upstream side of the feeding path and from a feeding speed, the CPU 50 predicts the timing when the recording material 16 is discharged may also be employed. Incidentally, in the case where an adjusting operation such as image adjustment is performed after an end of continuous print, the image forming apparatus 100 may also go to the stand-by state after waiting for an end of the adjusting operation.

In this embodiment, the image forming operation corresponding to the execution instruction is continuous print of 100 sheets and the case where the image forming apparatus goes to the stand-by state after the continuous print of 100 sheets is ended will be described as an example. Here, the continuous print refers to continuous execution of the image forming operation of a plurality of sheets (at least two sheets, in this embodiment, 100 sheets) of the recording materials 16 having the same kind and the same size.

When the print execution instruction is inputted to the CPU 50, the CPU 50 switches the voltage source potential of the infrared irradiating device 13 to a turning-on voltage source potential, so that the feeding belt 14 is heated until the temperature of the feeding belt 14 becomes the target temperature (in this embodiment, 60° C., hereinafter, referred to as a print temperature). Further, the feeding belt 14 continuously rotates. Further, the CPU 50 causes the ultraviolet irradiating device 12 to irradiate the feeding belt 14 with the ultraviolet radiation (UV on).

When the temperature of the feeding belt 14 becomes the print temperature, the fixing portion 11 is in a state in which the fixing process is capable of being started. The CPU 50 controls operations of the image forming portion 10 and the driving means 52 for the feeding mechanism. Incidentally, in this embodiment, in response to that the temperature of the feeding belt 14 becomes the print temperature, the image forming portion 10 starts to form the image on the photosensitive drum. On and after the feeding belt 14 starts feeding of a first recording material in the continuous print, the CPU 50 causes the feeding belt 14 to continuously feed the recording material 16, so that the fixing process is executed.

As described above, in the image forming apparatus 100, before the recording material 16 is fed, the feeding belt 14 is warmed so that the temperature thereof is maintained at a predetermined temperature, so that even in the case where the continuous print is executed, the temperature of the feeding belt 14 can be stabilized. Accordingly, even in the case where the continuous print is executed, a fixing property can be stabilized. Further, as described above, in the stand-by state, the temperature of the feeding belt 14 is maintained at the stand-by temperature, whereby the time from the input of the print execution instruction signal to the CPU 50 to the print start can be shortened.

In the case where the continuous print is executed, the CPU 50 causes the infrared irradiating device 13 to continuously irradiate the feeding belt 14 with the infrared radiation not only when the recording material 16 ranges through the infrared irradiation position but also in a sheet interval. That is, the CPU 50 does not cause the infrared irradiating device 13 to be turned off in a period from a start of feeding of a first sheet of the recording material 16 in the continuous print by the feeding belt 14 until a 100-th sheet (final sheet of the continuous print) of the recording material 16 completely passes through the infrared irradiation position. The infrared irradiating device 13 heats the feeding belt 14 in a period from passage of a trailing end of a prior recording material 6 (for example, the first sheet) through the infrared irradiation position until a leading end of a subsequent recording material 16 (for example, a second sheet) reaches the infrared irradiation position. During execution of the continuous print, the feeding belt 15 continuously rotates. With feeding of the recording material 16 by the feeding belt 14, heat of the feeding belt 14 to taken by the recording material 16, so that there is a liability that the temperature of the feeding belt 15 lowers as a whole. Even in the sheet interval, by irradiating the feeding belt 14 with the infrared radiation by the infrared irradiating device 13, it is possible to suppress the lowering in temperature of the feeding belt 14 as a whole.

After the end of the continuous print, the image forming apparatus goes to the stand-by state, and therefore, the CPU 50 controls the output of the infrared heater 17 so that the temperature of the feeding belt 14 is maintained at the stand-by temperature. Incidentally, in this embodiment, a constitution in which the target temperature of the feeding belt 14 is changed from the print temperature to the stand-by temperature at timing when the 100-th sheet (the final sheet of the continuous print) of the recording material 16 is discharged to the outside of the image forming apparatus is employed, but the present invention is not limited thereto. For example, a constitution in which in response to the end of the passage of the 100-th sheet (the final sheet of the continuous print) of the recording material 16 through the infrared irradiation position, the CPU 50 changes the target temperature of the feeding belt 14 from the print temperature to the stand-by temperature and controls the output of the infrared heater 17 may also be employed. Further, for example, a constitution in which in response to the end of the passage of the 100-th sheet (the final sheet of the continuous print) of the recording material 16 through the feeding belt 14, the CPU 50 changes the target temperature of the feeding belt 14 from the print temperature to the stand-by temperature and controls the output of the infrared heater 17 may also be employed. Even in these cases, in the stand-by state after the continuous print, the CPU 50 controls the output of the infrared heater 17 so that the temperature of the feeding belt 14 is maintained at the stand-by temperature.

Further, in the case where for example, an adjusting operation such as cleaning of the fixing portion 11 is performed with the end of the continuous print, the image forming apparatus 100 goes to the stand-by state after an end of the adjusting operation. In this case, after the end of the adjusting operation of the fixing portion 11, the CPU 50 may also control the output of the infrared heater 17 so that the temperature of the feeding belt 14 becomes the stand-by temperature. Even in this case, in the stand-by state after the continuous print, the CPU 50 controls the output of the infrared heater 17 so that the temperature of the feeding belt 14 is maintained at the stand-by temperature.

Further, in the case where the continuous print is executed, the CPU 50 causes the ultraviolet irradiating device 12 to continuously irradiate the feeding belt 14 with the ultraviolet radiation not only when the recording material 16 ranges through the ultraviolet irradiation position but also in a sheet interval. That is, the CPU 50 does not cause the ultraviolet irradiating device 12 to be turned off in a period from a start of feeding of a first sheet of the recording material 16 in the continuous print by the feeding belt 14 until a 100-th sheet (final sheet of the continuous print) of the recording material 16 completely passes through the ultraviolet irradiation position. The ultraviolet irradiating device 12 heats the feeding belt 14 in a period from passage of a trailing end of a prior recording material 6 (for example, the first sheet) through the ultraviolet irradiation position until a leading end of a subsequent recording material 16 (for example, a second sheet) reaches the ultraviolet irradiation position. With feeding of the recording material 16 by the feeding belt 14, heat of the feeding belt 14 is taken by the recording material 16, so that there is a liability that the temperature of the feeding belt 14 lowers as a whole. As described above, also the ultraviolet radiation irradiation has a heating effect although the heating effect is smaller than a heating effect by the infrared radiation irradiation. Even in the sheet interval, by irradiating the feeding belt 14 with the ultraviolet radiation by the ultraviolet irradiating device 12, it is possible to suppress the lowering in temperature of the feeding belt 14 as a whole. After the end of passage of the 100-th sheet (the final sheet of the continuous print) of the recording material 16 through the ultraviolet irradiation position, the CPU 50 turns off the ultraviolet irradiating device 12.

Incidentally, in this embodiment, the time of the end of the passage of the 100-th sheet (the final sheet of the continuous print) of the recording material 16 through the ultraviolet irradiation position is the timing when the CPU 50 turns off the ultraviolet irradiating device 12, but the present invention is not limited thereto. For example, the timing when the CPU 50 turns off the ultraviolet irradiating device 12 may also be a time when the 100-th sheet (the final sheet of the continuous print) of the recording material 16 completely passes through the feeding belt 14. Further, the timing may also be a time when the 100-th sheet (the final sheet of the continuous print) of the recording material 16 is discharged to the outside of the image forming apparatus.

Further, in the stand-by state after the end of the continuous print, the CPU 50 does not cause the ultraviolet irradiating device 12 to irradiate the feeding belt 14 with the ultraviolet radiation (UV off).

Incidentally, during the continuous print, the ultraviolet irradiating device 12 and the infrared irradiating device 13 were continuously turned on, but this does not apply to during an occurrence of abnormality. For example, at the time of an occurrence of a jam and in the case of abnormal temperature rise, the continuous print is interrupted and the ultraviolet irradiating device 12 and the infrared irradiating device 13 may also be turned off.

Further, incidentally, the timing when the recording material 16 passes through the infrared irradiation position is detected by the CPU 50 on the basis of an output of a sensor provided at the belt feeding portion 6. Specifically, the belt feeding portion 6 is provided immediately downstream of the infrared irradiation position with a sensor (not shown, for example an optical sensor) for detecting passage of the recording material 16. The CPU 50 detects the passage of the final recording material 16 on the basis of the output of this sensor. Incidentally, a detecting method of the timing when the recording material 16 passes through the infrared irradiation position is not limited thereto. For example, a constitution in which from an output of a sensor provided on a further upstream (or further downstream) side of the feeding path and from the feeding speed, the CPU 50 predicts timing when the recording material 16 passes (or passed) through the infrared irradiation position may also be employed. Further, incidentally, this is ditto for a detecting method of the timing when the recording material 16 passed through the ultraviolet irradiation position.

Incidentally, values of the target temperatures (the rising temperature, the stand-by temperature, the print temperature) shown in this embodiment are an example, and the values of the target temperatures are not limited thereto. Further, these set temperatures are stored in advance in a storing means incorporated in the CPU 50.

[Embodiment 2]

Embodiment 1 has a constitution in which the image forming apparatus 100 includes the temperature sensor 54 and the CPU 50 controls the temperature of the feeding belt 14 on the basis of the output of the temperature sensor 54 in the rising period and in the stand-by period. In this embodiment, the CPU 50 does not use the output of the temperature sensor 54 as a trigger and carries out predictive control.

For example, the CPU 50 controls the output of the infrared irradiating device 13 on the basis of an irradiation time stored in the storing means incorporated in the CPU 50. Specifically, in the storing means, data of an infrared radiation irradiation time by the infrared irradiating device 13 corresponding to a temperature change of the feeding belt 14 as shown in FIG. 11 are stored in advance. For example, the CPU 50 causes the infrared irradiating device 13 to have the turning-on voltage source potential of V=H(V) for 10 minutes from a start of turning-on of a power (main) switch 40. By this, the CPU 50 heats the feeding belt 14 and causes the fixing portion 11 to rise. Further, for example, in the stand-by state, the CPU 50 repeats a process such that the voltage source potential is maintained for 3 minutes at the intermediary voltage source potential (V=M(V)) and then is maintained for 2 minutes at the turning-on voltage source potential (V=H(V). By this, the CPU 50 carries out control so that in the stand-by state, the temperature of the feeding belt 14 falls within a predetermined temperature range. Thus, the CPU 50 may also control the temperature of the feeding belt 14. The time is measured by the CPU 50 as a timer.

Incidentally, as regards other constitutions, these constitutions are similar to those in Embodiment 1 and therefore will be omitted from description.

[Embodiment 3]

In Embodiments 1 and 2, a constitution in which the feeding belt 13 is a single belt for feeding the recording material 16 so as to pass through both the infrared irradiation position and the ultraviolet irradiation position, but may also be two feeding belts. Specifically, a feeding belt for infrared radiation for causing the recording material 16 to pass through the infrared irradiation position and a feeding belt for ultraviolet radiation for causing the recording material 16 to pass through the ultraviolet irradiation position are provided.

Other constitutions and control may only be required to be similar to those in the above-described Embodiments 1 and 2. In this embodiment, the temperature of the feeding belt A is maintained at a target temperature by the infrared irradiating device 13 similarly as in the case of the feeding belt 14. For example, in the stand-by state, the temperature of the feeding belt A is maintained at the stand-by temperature by the infrared irradiating device 13. In the stand-by state, by maintaining the temperature of the feeding belt A at the stand-by temperature, the time from the input of the print execution instruction signal to the CPU 50 to the print start can be shortened. Further, even in the case where the continuous print is executed, the temperature of the feeding belt A can be stabilized.

[Embodiment 4]

In this embodiment, a material of the feeding belt 14 is different from that in Embodiments 1 to 3 described above. Other points are similar to those in Embodiments 1 to 3, and therefore will be omitted from description.

A main component of the feeding belt in this embodiment is a fluorine-containing rubber. Further, the feeding belt contains graphite in place of the carbon black. In this embodiment, a fluorinated compound is contained in the feeding belt, whereby a deterioration of the feeding belt by the ultraviolet radiation can be suppressed. In the following, the reason therefor will be described.

FIG. 12 is a table showing dissociation energy corresponding wavelengths of various bonds. Dissociation energy (corresponding wavelength) of C—C bond of an organic material is 340 nm, and therefore, with light of a wavelength of 365 nm-405 nm, a probability of dissociation of the C—C bond is low. However, when the organic material (compound) is exposed to the light of 365 nm-405 nm, a surface of the organic material is oxidized, so that C—O bond is formed. Such a bond is dissociated at a longer wavelength (370 nm) than C—C (bond), and therefore, when the organic material is irradiated with the light of 365 nm-405 nm in wavelength, the bond is dissociated and acts as a trigger for decomposition reaction of the organic material.

However, the fluorinated compound is used as the organic material, so that the wavelength of energy for dissociating the C—C bond shifts to a short wavelength. This is the same tendency in the C—O bond containing fluorine. For that reason, as in this embodiment, the main component of the feeding belt is the fluorine-containing rubber, so that the organic material is not readily dissociated even when irradiated with the light of 365 nm-405 nm. As the feeding belt of this embodiment, a feeding belt in which for example, 30 weight parts of graphite is added to 100 weight parts of polyvinylidene fluoride resin can be used. Incidentally, this value is an example, and the present invention is not limited thereto. Further, a volume resistivity of the feeding belt 14 may desirably be less than $10^{10}$ (Ω.cm) similarly as in Embodiment 1.

INDUSTRIAL APPLICABILITY

According to the present invention, there is provided on image forming apparatus capable of suppressing irradiation energy of ultraviolet radiation necessary to cure the developer.

The invention claimed is:

1. An image forming apparatus comprising:

an image forming portion for forming an image on a sheet by using a developer including toner;

a feeding belt for feeding the sheet on which the image is formed by said image forming portion;

an infrared irradiating portion for irradiating, with infrared radiation, the image on the sheet fed by said feeding belt;

an ultraviolet irradiating portion for irradiating, with ultraviolet radiation, the image on the sheet having been irradiated with the infrared radiation by said infrared irradiating portion to fix the developer on the sheet by ultraviolet radiation; and a controller for controlling operations of said feeding belt and said infrared irradiating portion, wherein said controller causes said infrared irradiating portion to irradiate said feeding belt with the infrared radiation while causing said feeding belt to rotate in a stand-by state in which said controller waits for an execution instruction of an image forming operation in a state in which the image forming operation is capable of being started.

2. An image forming apparatus according to claim 1, further comprising a detecting portion for detecting a temperature of said feeding belt, wherein in the stand-by state, said controller causes said infrared irradiating portion to irradiate said feeding belt with the infrared radiation so that the temperature detected by said feeding belt falls within a target temperature range.

3. An image forming apparatus according to claim 1, wherein said ultraviolet irradiating portion irradiates, with the ultraviolet radiation, the image on the sheet fed by said feeding belt.

4. An image forming apparatus according to claim 1, wherein said controller causes said feeding belt to continuously rotate during the stand-by state.

5. An image forming apparatus according to claim 1, wherein said controller causes said infrared irradiating portion to irradiate said feeding belt with the infrared radiation during the stand-by state.

6. An image forming apparatus according to claim 1, wherein during the stand-by state, said ultraviolet irradiating portion does not irradiate said feeding belt with the ultraviolet radiation.

7. An image forming apparatus according to claim 1, wherein in a case that said image forming apparatus continuously form images on a plurality of sheets, said infrared irradiating portion continuously irradiates said feeding belt with the infrared radiation in a period from passing of a trailing end of a prior sheet through an infrared irradiating position where the sheet is irradiated with the infrared radiation by said infrared irradiating portion to passing of a leading end of a sheet fed subsequently to the prior sheet, through the infrared irradiating position.

8. An image forming apparatus according to claim 1, wherein said feeding belt contains a carbon material selected from the group consisting of carbon black, activated carbon, nanocarbon and graphite, and wherein said ultraviolet irradiating portion irradiates the image, on the sheet fed by said feeding belt, with the ultraviolet radiation, and in a case that said image forming apparatus continuously forms images on a plurality of sheets, said ultraviolet irradiating portion continuously irradiates said feeding belt with the ultraviolet radiation in a period from passing of a trailing end of a prior sheet through an ultraviolet irradiating position where the sheet is irradiated with the ultraviolet radiation by said ultraviolet irradiating portion to passing of a leading end of a sheet fed subsequently to the prior sheet, through the ultraviolet irradiating position.

9. An image forming apparatus according to claim 1, wherein said controller causes said infrared irradiating portion to irradiate said feeding belt after said feeding belt starts rotation thereof in a period from turning-on of a power switch of said image forming apparatus until said image forming apparatus is in the stand-by state, and thus said feeding belt is heated.

10. An image forming apparatus according to claim 1, wherein in a case that an execution instruction of an image forming operation is inputted in a period from turning-on of a power switch of said image forming apparatus until said image forming apparatus is in the stand-by state, said controller causes said image forming apparatus to start the image forming operation without going to the stand-by state.

11. An image forming apparatus comprising:

an image forming portion for forming an image on a sheet by using a developer;

a feeding belt for feeding the sheet on which the image is formed by said image forming portion;

an infrared irradiating portion for irradiating, with infrared radiation, the image on the sheet fed by said feeding belt;

an ultraviolet irradiating portion for irradiating, with ultraviolet radiation, the image on the sheet fed by said feeding belt; and a controller for controlling operations of said feeding belt and said infrared irradiating portion, wherein said controller causes said infrared irradiating portion to irradiate said feeding belt with the infrared radiation while causing said feeding belt to rotate in a stand-by state in which said controller waits for an execution instruction of an image forming operation in a state in which the image forming operation is capable of being started.

12. An image forming apparatus according to claim 11, further comprising a detecting portion for detecting a temperature of said feeding belt, wherein in the stand-by state, said controller causes said infrared irradiating portion to irradiate said feeding belt with the infrared radiation so that the temperature detected by said feeding belt falls within a target temperature range.

13. An image forming apparatus according to claim 11, wherein said ultraviolet irradiating portion irradiates, with the ultraviolet radiation, a region irradiated with the infrared radiation by said infrared irradiating portion in the image on the sheet fed by said feeding belt.

* * * * *